US009714570B2

(12) United States Patent
Gisolf

(10) Patent No.: US 9,714,570 B2
(45) Date of Patent: Jul. 25, 2017

(54) PACKER-PACKER VERTICAL INTERFERENCE TESTING

(71) Applicant: Schlumberger Technology Corporation, Sugar Land, TX (US)

(72) Inventor: Adriaan Gisolf, Houston, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 426 days.

(21) Appl. No.: 14/319,699

(22) Filed: Jun. 30, 2014

(65) Prior Publication Data

US 2015/0007985 A1 Jan. 8, 2015

Related U.S. Application Data

(60) Provisional application No. 61/842,794, filed on Jul. 3, 2013.

(51) Int. Cl.
*E21B 49/00* (2006.01)

(52) U.S. Cl.
CPC ..... *E21B 49/008* (2013.01)

(58) Field of Classification Search
CPC ..... E21B 49/00; E21B 49/008
See application file for complete search history.

(56) References Cited

U.S. PATENT DOCUMENTS 4,069,866 A 1/1978 Upchurch
5,549,159 A 8/1996 Shwe et al.
7,913,557 B2 3/2011 Vasques et al.
8,015,869 B2 9/2011 Nold, III et al.
8,078,403 B2 12/2011 Zhang et al.
8,473,214 B2 6/2013 Gok et al.
8,528,394 B2 9/2013 Eriksen
2010/0050762 A1* 3/2010 Nold, III ..... E21B 49/088 73/152.51

FOREIGN PATENT DOCUMENTS

WO 2013055691 A2 4/2013

OTHER PUBLICATIONS

Examination Report issued in related AU application 2014203598 on Jun. 30, 2015, 5 pages.

* cited by examiner

*Primary Examiner* — Brad Harcourt
(74) *Attorney, Agent, or Firm* — Michael Dae

(57) ABSTRACT

A downhole tool having multiple packers and a controller operable to operate the packers to establish upper, middle, and lower intervals. The controller then establishes the upper and lower intervals at formation pressure, and establishes the middle interval at hydrostatic pressure. The controller then creates a pressure signal in one of the upper and lower intervals and then records a resulting pressure transient in both of the upper and lower intervals. The controller is also operable to establish the middle interval at formation pressure and establish the upper and lower intervals at below hydrostatic pressure but above formation pressure, and then create the pressure signal in the middle interval and subsequently record a resulting pressure transient in the middle interval.

19 Claims, 6 Drawing Sheets

PACKER-PACKER VERTICAL INTERFERENCE TESTING

CROSS-REFERENCE TO RELATED APPLICATIONS

This application claims priority to, and the benefit of, U.S. Provisional Patent Application No. 61/842,794, entitled "Packer-Packer Vertical Interference Testing," filed Jul. 3, 2013.

BACKGROUND OF THE DISCLOSURE

In an Interval Pressure Transient Test (IPTT), a formation tester tool is utilized to pump fluid from a single point or small interval of the formation into the wellbore. Various reservoir characteristics may be determined from the transient reservoir pressure response. In a Vertical Interference Test (VIT), one or more pressure monitoring devices may be positioned above or below the pressure source. The pressure monitoring devices may measure and/or cause additional pressure transients and can further characterize the reservoir and test for vertical connectivity.

SUMMARY OF THE DISCLOSURE

The present disclosure introduces a method in which a downhole tool is positioned within a wellbore that extends into a subterranean formation. The downhole tool comprises a plurality of packers, the wellbore comprises wellbore fluid at hydrostatic pressure, and the subterranean formation comprises formation fluid at formation pressure. The packers are operated to establish a plurality of annular intervals within the wellbore. The intervals include an upper interval, a lower interval, and a middle interval interposing the upper and lower intervals. The downhole tool is operated to establish the upper and lower intervals at formation pressure and establish the middle interval at hydrostatic pressure, and then create a pressure signal in one of the upper and lower intervals and subsequently record a resulting pressure transient in both of the upper and lower intervals.

The present disclosure also introduces a method in which a downhole tool is positioned within a wellbore that extends into a subterranean formation, wherein the downhole tool comprises a plurality of packers, the wellbore comprises wellbore fluid at hydrostatic pressure, and the subterranean formation comprises formation fluid at formation pressure. The packers are operated to establish a plurality of annular intervals within the wellbore, including an upper interval, a lower interval, and a middle interval interposing the upper and lower intervals. The downhole tool is then operated to establish the middle interval at formation pressure and establish the upper and lower intervals at below hydrostatic pressure but above formation pressure, and then create a pressure signal in the middle interval and subsequently record a resulting pressure transient in the middle interval.

The present disclosure also introduces a downhole tool conveyable within a wellbore that extends into a subterranean formation, wherein the wellbore comprises wellbore fluid at hydrostatic pressure, the subterranean formation comprises formation fluid at formation pressure, and the downhole tool comprises a plurality of packers and a controller. The controller is operable to operate the packers to establish a plurality of annular intervals within the wellbore, including an upper interval, a lower interval, and a middle interval interposing the upper and lower intervals. The controller is further operable to establish the upper and lower intervals at formation pressure and establish the middle interval at hydrostatic pressure, and then create a pressure signal in one of the upper and lower intervals and subsequently record a resulting pressure transient in both of the upper and lower intervals.

These and additional aspects of the present disclosure are set forth in the description that follows, and/or may be learned by a person having ordinary skill in the art by reading the materials herein and/or practicing the principles described herein. At least some aspects of the present disclosure may be achieved via means recited in the attached claims.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
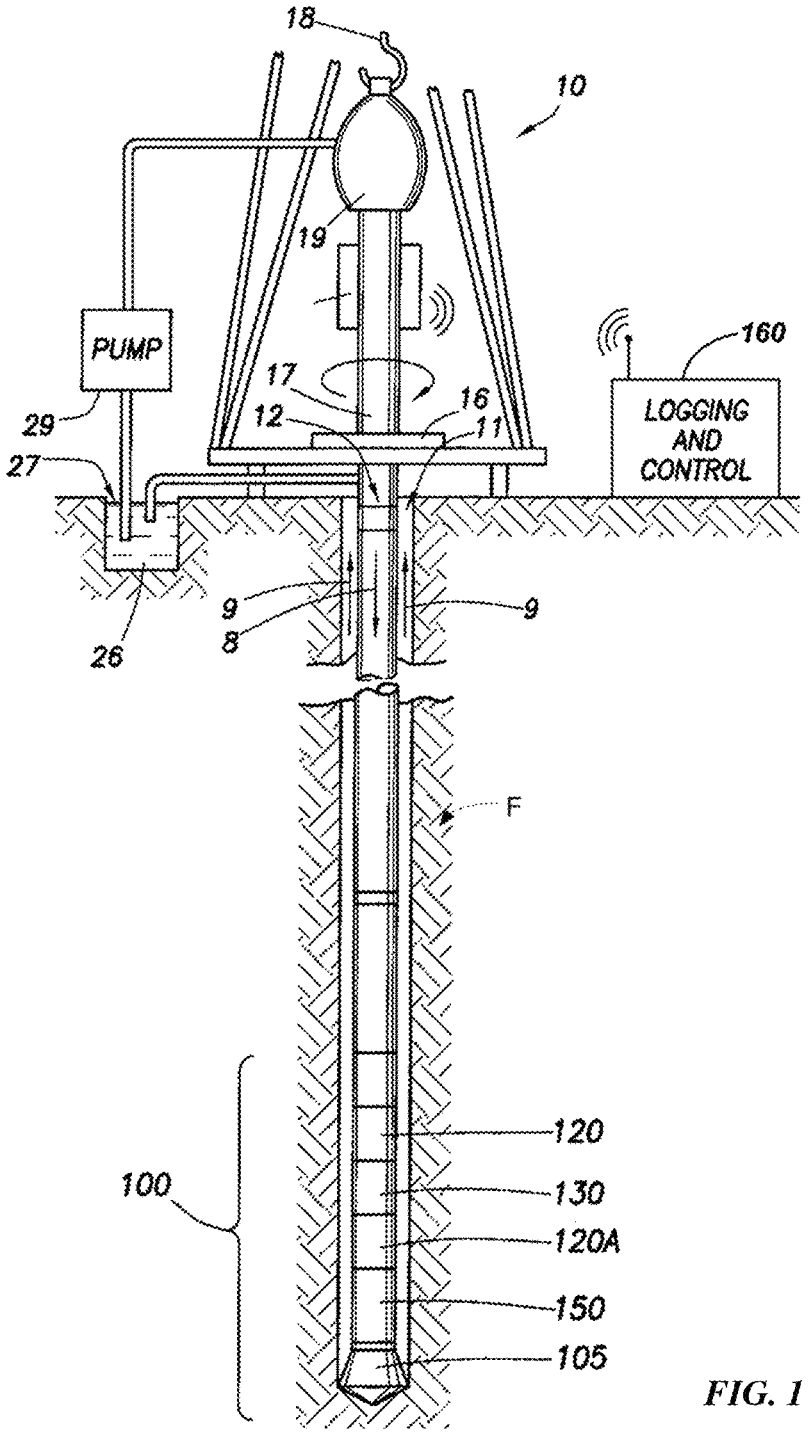
FIG. 1 is a schematic view of at least a portion of apparatus according to one or more aspects of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for simplicity and clarity, and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

FIG. 1 is a schematic view of an example wellsite drilling system that can be employed onshore and/or offshore. In the example wellsite system of FIG. 1, a borehole 11 is formed in one or more subsurface formations F by rotary and/or directional drilling. A drill string 12 is suspended within the borehole 11 and has a bottom hole assembly (BHA) 100 having an optional drill bit 105 at its lower end. A surface system includes a platform and derrick assembly 10 positioned over the borehole 11. The example derrick assembly 10 may include a rotary table 16, a kelly 17, a hook 18 and a rotary swivel 19. The drill string 12 is rotated by the rotary table 16, energized by means not shown, which engages the kelly 17 at the upper end of the drill string 12. The example drill string 12 is suspended from the hook 18, which is attached to a traveling block (not shown), and through the kelly 17 and the rotary swivel 19, which permits rotation of the drill string 12 relative to the hook 18. A top drive system could also or instead be utilized within the scope of the present disclosure.

The surface system further includes drilling fluid or mud 26 stored in a pit 27 formed at the well site. A pump 29 delivers the drilling fluid 26 to the interior of the drill string 12 via a port in the swivel 19, causing the drilling fluid to flow downwardly through the drill string 12 as indicated by the directional arrow 8. The drilling fluid 26 exits the drill string 12 via ports in the drill bit 105 (in implementations utilizing the bit 105), and then circulates upwardly through the annulus region between the outside of the drill string 12 and the wall of the borehole 11, as indicated by the directional arrows 9.

The example BHA 100 may include, among other things, various numbers and/or types of logging-while-drilling (LWD) modules (two of which are designated by reference numerals 120 and 120A) and/or measuring-while-drilling (MWD) modules (one of which is designated by reference numeral 130), a roto-steerable system or mud motor 150, and the optional drill bit 105, among other components and/or modules.

The example LWD modules 120 and 120A may each be housed in a special type of drill collar, as it is known in the art, and may each contain various logging tools and/or fluid sampling devices. The example LWD modules 120, 120A may include capabilities for measuring, processing, and/or storing information, as well as for communicating with surface equipment, such as a logging and control computer 160 via, for example, the MWD module 130.

The example MWD module 130 of FIG. 1 is also housed in a special type of drill collar and contains one or more devices for measuring characteristics of the drill string 12 and/or the drill bit 105. The example MWD tool 130 further includes an apparatus (not shown) for generating electrical power for use by the downhole system. Example devices to generate electrical power include, but are not limited to, a mud turbine generator powered by the flow of the drilling fluid, and a battery system. Example measuring devices include, but are not limited to, a weight-on-bit measuring device, a torque measuring device, a vibration measuring device, a shock measuring device, a stick slip measuring device, a direction measuring device, and an inclination measuring device.

Figure 2:
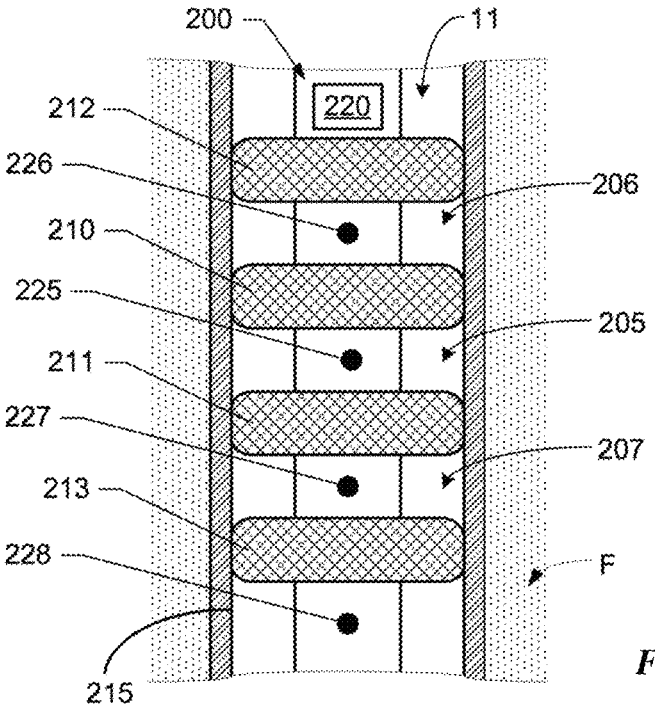
FIG. 2 is a schematic view of at least a portion of apparatus according to one or more aspects of the present disclosure.

FIG. 2 is a schematic illustration of an example manner of implementing the example LWD modules 120 and/or 120A of FIG. 1 and/or other modules conveyed via drill string and/or wireline and operable to perform formation testing according to one or more aspects of the present disclosure. To seal off intervals 205, 206, and 207 of the wellbore 11, the module 200 includes packers 210, 211, 212 and 213. The example packers 210-213 are inflatable elements that encircle the generally cylindrical shaped module 200. The example intervals 205-207 formed by the packers 210-213 likewise encircle the module 200. When inflated to form a seal with a wall 215 of the wellbore 11, the upper packers 212 and 210 form the upper interval 206, the lower packers 211 and 213 form the lower interval 207, and the inner packers 210 and 211 form the middle interval 205.

The example packers 210-213 depicted in FIG. 2 may have a height of about 0.5 m and a spacing of about 1 m. However, other size packers and/or packer spacing(s) may be also or instead be utilized.

To allow the example pressure testing system 220 to be fluidly coupled to the intervals 205-207, the example module 200 includes ports 225, 226, and 227 for respective ones of the intervals 205-207. As described below in connection with FIGS. 3 and 4, the example pressure testing system 220 of FIG. 2 may be operable to pump fluid from the middle interval 205 via the port 225, such as would perform a cleanup or sampling operation of the middle interval 205, and/or to drawdown the pressure in the middle interval 205 and measure subsequent pressure buildup data. The example pressure testing system 220 is also able to draw fluid out of and/or push fluid into the upper and lower intervals 206 and 207 to adjust, control, and/or maintain pressure(s) in the upper and lower intervals 206 and 207. For example, the pressure testing system 220 may reduce the pressure in the upper and lower intervals 206 and 207 to approximately the formation pressure, or to a pressure between the formation pressure and the hydrostatic (wellbore) pressure, while the middle interval 205 is drawn down to perform a pressure buildup test. However, in other implementations, the reverse may be true, such that the pressure testing system 220 may reduce the pressure in the middle intervals 205 to approximately the formation pressure, or to a pressure between the formation pressure and the hydrostatic pressure, while the upper and lower intervals 206 and 207 are drawn down.

The example pressure testing system 220 may also be fluidly coupled to a port 228 located below the lower packer 213, or to a similar port (not shown) located above the upper packer 212. Such ports may be directly exposed to the fluid and, thus, fluid pressure that are present in the wellbore 11. Moreover, the port 228 may be fluidly coupled to an additional port (not shown) located above the upper packer 212, such as via a bypass flowline of the module 200 (not shown). Among other things, the example port 228 may be utilized to balance the pressure of the portion of the wellbore 11 located above the upper packer 212 with the pressure of the portion of the wellbore 11 located below the lower packer 213.

One or more probes (not shown) having pretest capabilities may also be implemented to perform formation pressure and/or mobility measurements in one or more of the intervals 206 and 207, below the lower packer 213, and/or above the upper packer 212. Such probes may be utilized to obtain values representative of formation parameters in a substantially shorter time period than when using a packer interval. Formation parameter values obtained with the probe(s) may be utilized by the pressure testing system 220, for example, to maintain the pressures in the upper and lower intervals 206 and 207 to be substantially equal to (or having a fixed offset from) the formation pressure. Pressure values obtained with the probe(s) may also or instead be utilized to determine propagation properties of pressure pulses in the formation.

Figure 3:
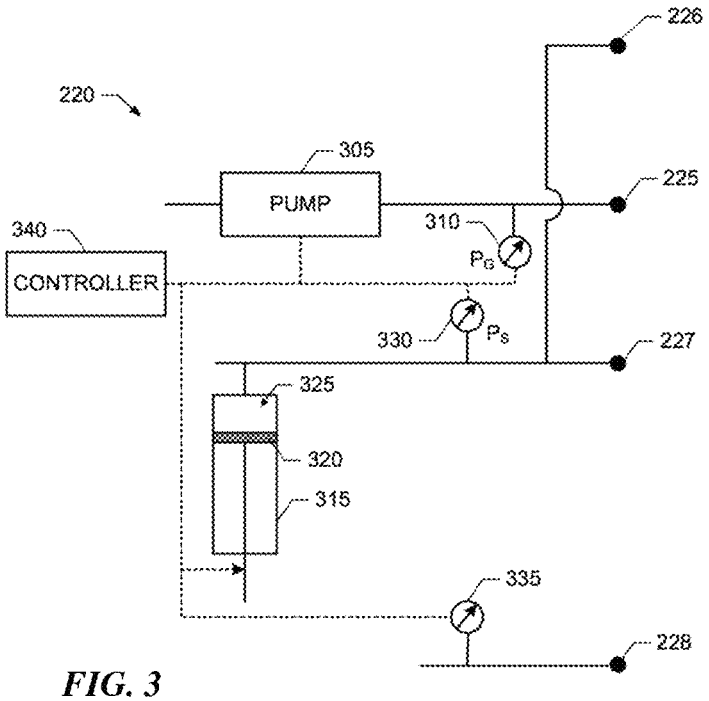
FIG. 3 is a schematic view of at least a portion of apparatus according to one or more aspects of the present disclosure.

FIG. 3 is a schematic diagram of an example manner of implementing the pressure testing system 220 shown in FIG. 2. To pump fluid from the middle interval 205 via the port 225, the example pressure testing system 220 may include a pump 305. When activated, the pump 305 may pump fluid from the middle interval 225 to, for example, a sample container and/or bottle, the wellbore 11 (e.g., via a bypass flowline (not shown)), and/or a fluid analysis module. The pump 305 may be utilized to pump fluid from the middle interval 205 to drawdown the pressure $P_S$ of the middle interval 205 as part of a pressure test. For example, the middle interval pressure $P_S$ may be reduced by the pump 305 to a pressure that is less than the formation pressure $P_F$. In some examples, the pump 305 may operate until a specified amount of formation fluid has been pumped. The pump 305 may also or instead operate until the drawdown pressure is reached, at which time the pump 305 may be stopped, and the middle interval pressure $P_S$ may be measured while it builds back up towards the formation pressure $P_F$, perhaps while the volume(s) of the flowlines and/or chambers fluidly coupled to the port 225 are held constant. To measure the middle interval pressure $P_S$, the example pressure testing system 220 may include various types of pressure gauges 310.

To adjust the pressure in the upper and lower intervals 206 and 207, the pressure testing system 220 may include various types of pumping means 315. The pump 315 may be controllable to pump fluid into and/or out of the upper and lower intervals 206 and 207 to increase and/or decrease the pressure in the upper and lower intervals 206 and 207, respectively. The 315 may be or comprise a hydraulic piston 320 operable to adjust the volume in a chamber 325 fluidly coupled to the ports 226 and 227. To measure the pressure $P_G$ of the upper and lower intervals 206 and 207, the pressure testing system 220 may comprise various types of pressure gauges 330. To measure the pressure $P_W$ of the wellbore 11, the pressure testing system 220 may comprise various types of pressure gauges 335. In some implementations, a single pump may be utilized to function as both the pump 305 and the pump 315.

To perform pressure testing according to one or more aspects of the present disclosure, the pressure testing system 220 includes a controller 340. For example, the controller 340 may be operable to control the pump 305 and piston 320 to initiate a pressure test, and to measure the pressure in the middle interval 205 during the subsequent pressure buildup phase, such as via the pressure gauge 310. The controller 340 may also be operable to control the inflation and deflation of the packers 210-213. The controller 340 may be implemented by various types of general-purpose processors, processor cores, and/or microcontrollers, among other possibilities within the scope of the present disclosure. The controller 340 may also or instead be implemented by one or more circuit(s), programmable processor(s), application specific integrated circuit(s) (ASIC(s)), programmable logic device(s) (PLD(s)) and/or field programmable logic device(s) (FPLD(s)), etc., and/or other combinations of hardware, firmware, and/or software.

Figure 4:
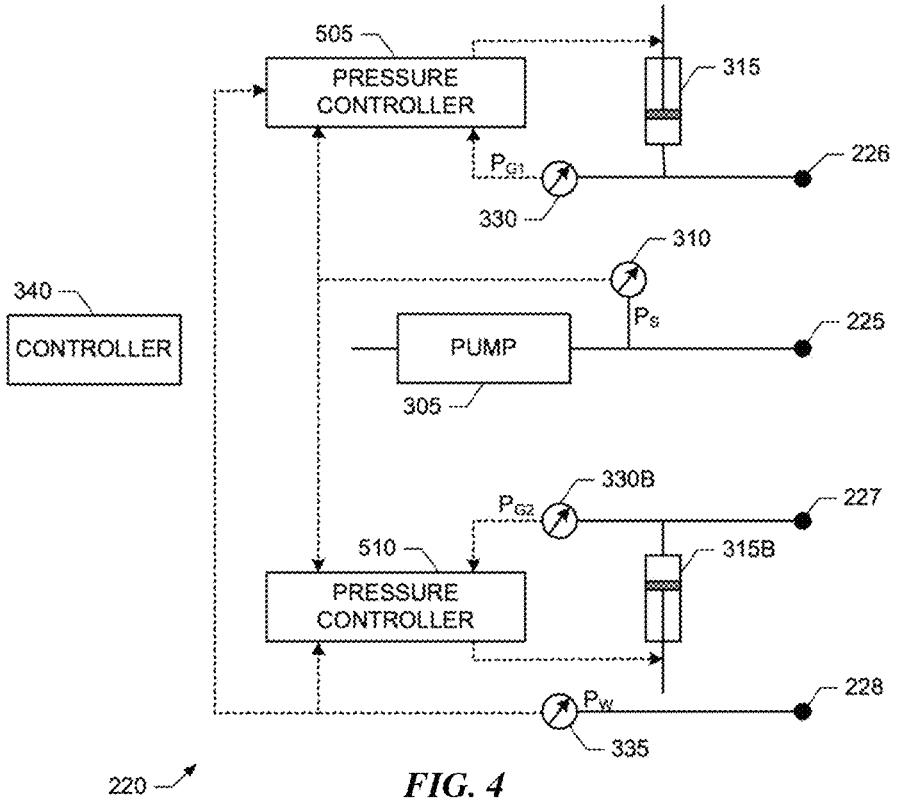
FIG. 4 is a schematic view of at least a portion of apparatus according to one or more aspects of the present disclosure.

FIG. 4 is a schematic view of another example manner of implementing the pressure testing system 220 depicted FIG. 2. Because elements of the pressure testing system 220 shown in FIG. 4 may be substantially similar to those discussed above in connection with FIG. 3, the descriptions of those similar or identical elements are not repeated here. Instead, substantially similar elements are illustrated with identical reference numerals in FIGS. 3 and 4.

In contrast to the pressure testing system 220 depicted in FIG. 3, the pressure testing system 220 depicted in FIG. 4 includes pressure controllers 505 and 510 for respective ones of the upper and lower intervals 206 and 207. The pressure controller 505 may be operable to, for example, actively control the pump 315 to maintain the upper interval pressure $P_{G1}$ of the upper interval 206 based on the middle interval pressure $P_S$ and the wellbore pressure $P_W$. For example, the pressure controller 505 may adapt and/or maintain the upper interval pressure $P_{G1}$ to be substantially equal to the middle interval pressure $P_S$. When the wellbore to drawdown pressure difference is large, the controller 505 may adapt the upper interval pressure $P_{G1}$ to distribute the pressure difference between the upper packers 212 and 210. The pressure $P_{G1}$ of the upper interval 206 may be measured by the pressure gauge 330.

Figure 5:
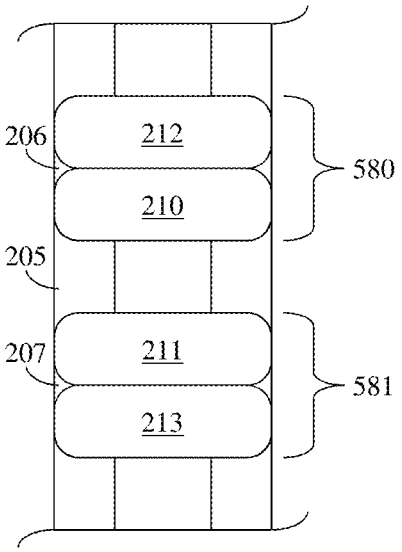
FIG. 5 is a schematic view of at least a portion of apparatus according to one or more aspects of the present disclosure.

Similarly, the pressure controller 510 depicted in FIG. 5 may be operable to, for example, actively control a pump 315B, which may be substantially similar to the example pump 315, to maintain the lower interval pressure $P_{G2}$ of the lower interval 207 based on the inner interval pressure $P_S$ and the wellbore pressure $P_W$. The pressure $P_{G2}$ of the lower interval 207 may be measured by a pressure gauge 330B, which may be substantially similar to the pressure gauge 330. The pressures $P_{G1}$ and $P_{G2}$ may be maintained at substantially the same or different pressures. For example, independent control of the pressure $P_{G1}$ in the upper interval 206 and the pressure $P_{G2}$ in the lower interval 207 may be beneficial when one of the outer packers 212, 213 experiences mechanical instability (e.g., creeping, sliding and/or deformation). In such circumstances, the pressure in the corresponding upper or lower intervals 206 or 207 may be adjusted, such as may minimize the impact of the mechanical instability of the outer packers 212, 213 on the pressure $P_G$ in the middle interval 205.

The pressure controllers 505 and 510 depicted FIG. 5 may be implemented by various types of general-purpose processors, processor cores, and/or microcontrollers. The pressure controllers 505 and 510 may also or instead be implemented by one or more circuit(s), programmable processor(s), ASIC(s), PLD(s) and/or FPLD(s), etc., and/or various combinations of hardware, firmware, and/or software.

In addition to controlling the pump 305 and measuring the pressure buildup data via the pressure gauge 310, as described above in connection with FIG. 3, the controller 340 of FIG. 5 may activate and/or deactivate the pressure controllers 505 and 510.

While example manners of implementing the example pressure testing system 220 of FIG. 2 have been illustrated in FIGS. 3 and 4, one or more of the elements, controllers, and/or devices illustrated in FIGS. 3 and/or 4 may be combined, divided, re-arranged, omitted, eliminated, and/or implemented in myriad other ways within the scope of the present disclosure. For example, the pressure controller 505 may be implemented in the pressure control system 220 of FIG. 2 to adapt, control, and/or maintain the pressure in both of the upper and lower intervals 206 and 207 via the pump 315. Further, a pressure testing system and/or module may include elements, controllers, and/or devices instead of, or in addition to, those illustrated in FIGS. 3 and/or 4, and/or may include more than one of the various illustrated elements, controllers, and/or devices.

One such modification may entail one or more combination packers 570 as depicted in FIG. 5. For example, each combination packer 570 may comprise upper and lower packer portions. Thus, the upper interval 206 may be defined by or otherwise be disposed between upper and lower portions 212 and 210 of an upper packer 580, the lower interval 207 may be defined by or otherwise be disposed between upper and lower portions 211 and 213 of a lower packer 581, and the middle interval 205 may be defined by or otherwise disposed between the lower portion 210 of the upper packer 580 and the upper portion 211 of the lower packer 581.

Conventionally, a VIT may be performed utilizing multi-probe or packer-probe formation testers. However, while the quad-packer implementations introduced herein may also be utilized for VIT's, the packer elements may not create a sufficient barrier against a pressure pulse. That is, a fraction of the pressure draw down (pulse) generated on one side of the packer can be transmitted through the packer. In conventional dual-packer transient testing, the draw down is generated between two packers. A resulting pressure transient transmitted from the isolated interval across the packer elements may reach the hydrostatic column, were the hydrostatic column may absorb it.

A multi-packer VIT entails N packer elements, creating N−1 intervals. During the testing procedure, the isolated intervals may each be drawn down to formation pressure, such as by pumping fluid from the intervals, and then pressure may be stabilized to formation pressure. To create a VIT, one of the intervals is drawn down or pulsed, while the neighboring interval(s) remain perturbed. Pressure change that propagates through the formation to the neighboring interval contains information about that formation. However, for such operations to be useful, the packer elements should not allow pressure propagation directly through the element. That is, a pressure pulse generated in one of the intervals will propagate through several packer elements and create a direct reaction in the neighboring intervals. This results in VIT data that is not accurately interpretable, because the VIT assumes that the pressure transmitted through the formation is being recorded, but not other pressure perturbations.

In the near-wellbore area, permeability data may be obtained through nuclear magnetic resonance (NMR) logs, and pretest buildup investigations may be conducted with a wireline formation testing tool. Although these data are useful, they reflect reservoir conditions within a limited zone of influence, and permeability values on a much larger scale are utilized to represent reservoir heterogeneity. Geostatistical models and reservoir simulation grid blocks utilize horizontal permeability ($k_h$) measurements from tens to hundreds of meters into the formation. Corresponding vertical permeability ($k_v$) values are also utilized. A lack of reliable vertical values often results in adjustment of the grid block vertical permeabilities used as history-matching parameters during reservoir simulation.

To perform the $k_v$ and $k_h$ measurements, the flow control module of the wireline formation testing tool may be operated to produce a 1000 $cm^3$ volume of formation fluid. The precise surface-controlled flow rate may be recorded for interpretation of the ensuing pressure data. For tests utilizing larger volumes, a pumpout module or sample chamber may also be utilized.

The depth of investigation of such wireline formation testing tool pretests is generally within the invaded zone, reflecting a limited volume near the wellbore. Pretest mobility values may agree with core plug data and NMR log-derived permeability values. However, although core measurements, magnetic resonance measurements, and wireline formation tester tool pretest permeability values may provide acceptable agreement across a reservoir cross-section, interference tests may indicate different values. For example, differences in vertical communication might indicate a permeability barrier. The increased depth of investigation of interference testing and the resulting determination of permeability anisotropy may provide a valuable perspective for reservoir characterization.

Accordingly, one or more aspects of the present disclosure may pertain to methods for prevent pressure pulses, transmitted through a packer element, from interfering with a VIT, such as by creating a buffer zone. The buffer zone may be a pressurized gas chamber or the hydrostatic fluid column. Similarly, a pressurized gas buffer may be connected to the upper and lower intervals of a quad packer toolstring, and the middle interval may be utilized for transient testing. The upper and lower intervals, being in fluid communication with such a pressurized gas buffer or hydrostatic pressure, may act as barriers against borehole pressure noise.

Figure 6:
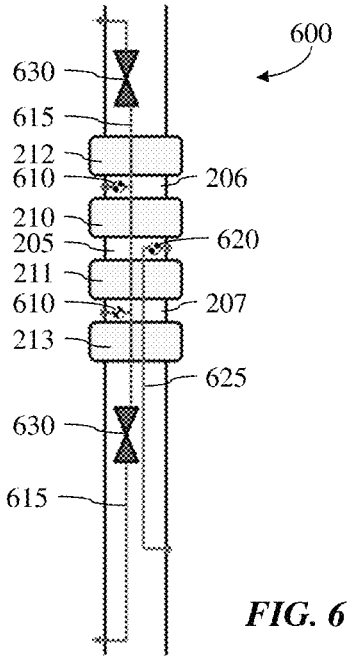
FIG. 6 is a schematic view of at least a portion of apparatus according to one or more aspects of the present disclosure.

For example, FIG. 6 is a schematic view of an example implementation 600 of the quad-packer systems described above, in which the quad-packer system 600 may be configured as a dual-dual packer system. The middle interval 205 between the second and third packers 210 and 211 is kept open to hydrostatic pressure. The upper interval 206 and lower interval 207 each have a valve 610 in the flowline 615 feeding the respective interval, and the middle interval 205 has a valve 620 connected to its flowline 625. The VIT procedure might comprise utilizing the upper and lower intervals 206 and 207. For example, referring concurrently to FIG. 10, which is a flow-chart diagram of at least a portion of an example implementation of a method (700) for performing such a VIT procedure, the packers 210-213 may each be inflated (705) such that they seal against the side of the wellbore. One or more pumps 630 of the quad-packer system 600 may then be operated to establish (710) the upper and lower intervals 206 and 207 substantially at formation pressure. The one or more pumps 630 may be transported downhole on drillstring, wireline, and/or other means, for example.

During this time, the middle interval 205 may be maintained at hydrostatic pressure, and may thus, for example, be open to hydrostatic flow. The middle interval 205 may be kept open via the flowline 625, which may parallel to the flowline 615 and/or otherwise not be in fluid communication with the flowline 615.

The quad-packer system 600, such as a controller thereof (as in the example implementations described above), may then be operated to create (715) a pressure pulse or signal in one of the upper or lower intervals 206 or 207, such as by operation of one or more of pumps 630. Pressure transmitted through the inner packer elements 210 and 211 will reach the middle interval 205. However, the middle interval 205 is open to hydrostatic pressure, so the generated pressure pulse or signal will be substantially absorbed by the compressibility of the hydrostatic column. The pressure transient may then be recorded (720) in one or both of the upper and lower intervals 206 and/or 207, such as by operation of the controller.

Figure 7:
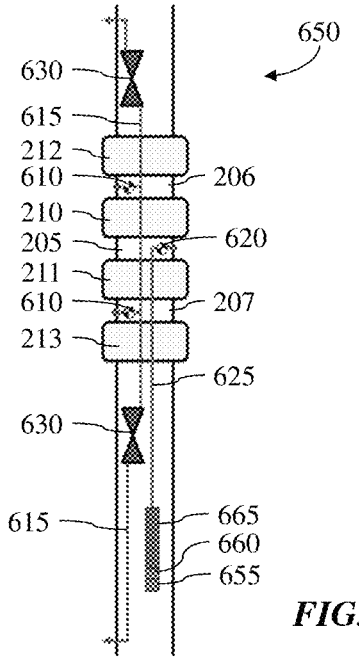
FIG. 7 is a schematic view of at least a portion of apparatus according to one or more aspects of the present disclosure.

FIG. 7 is a schematic view of another example implementation 650 of the quad-packer systems described above, in which the middle interval 205 is connected with a chamber 655 that contains pressurized gas below a piston 660 and wellbore fluid 665 above the piston. Before lowering the quad-packer system 650 into the well, the gas can be pressurized (e.g., at about 10 bar, or about 150 psi).

Figure 11:
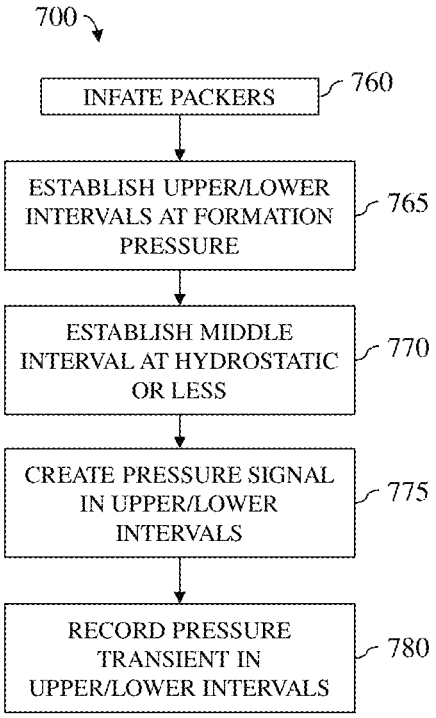
FIG. 11 is a flow-chart diagram of at least a portion of a method according to one or more aspects of the present disclosure.

Referring concurrently to FIG. 11, which is a flow-chart diagram of at least a portion of an example implementation of a method (750) for performing a VIT procedure, while lowering the quad-packer system 650 into the wellbore, the valve 620 remains open, allowing wellbore fluid to enter above the piston 660, thus permitting a pressure-equalized chamber 655 and flowline 625. Thereafter, the packers 210-213 are inflated (760), such as by an amount sufficient to seal each of the packers 210-213 to the sidewall of the borehole.

One or more pumps 630 of the quad-packer system 650 may then be operated to establish (765) the upper and lower intervals 206 and 207 substantially at formation pressure. The one or more pumps 630 may be transported downhole on drillstring, wireline, and/or other means, for example. The middle interval 205 may remain at hydrostatic pressure or pumped (770) to a pressure substantially lower than hydrostatic pressure (pump not shown).

Thereafter, a pressure pulse or signal may be created (775) in one of the upper or lower intervals 206 or 207, such as via operation of one or more of the pumps 630. If such pressure is transmitted through the inner packer elements 210 and 211, it will reach the middle interval 205, and thus be substantially absorbed by the compressibility of the gas in the chamber 655. The pressure transient in both the upper and lower intervals 206 and 207 may then be recorded (780), such as by the controller carried by or otherwise utilized in conjunction with the quad-packer system 650.

Figure 8:
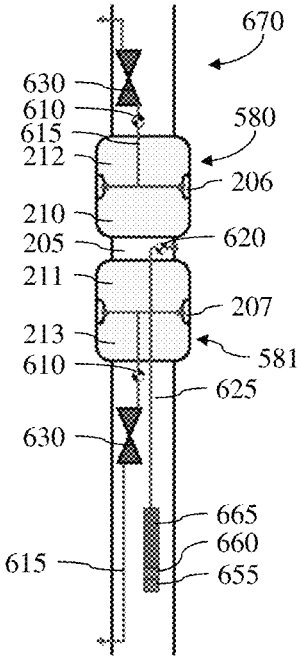
FIG. 8 is a schematic view of at least a portion of apparatus according to one or more aspects of the present disclosure.

FIG. 8 is a schematic view of another example implementation 670 of the quad-packer systems described above, embodied as a dual combination packer system similar to the apparatus shown in FIG. 5. A port 620 between the two packers 580 and 581 is connected with the chamber 655 that contains gas below a piston 660 and wellbore fluid 665 above the piston 660. Before lowering the dual combination packer system 670 into the well, the gas can be pressurized, as described above.

Figure 10:
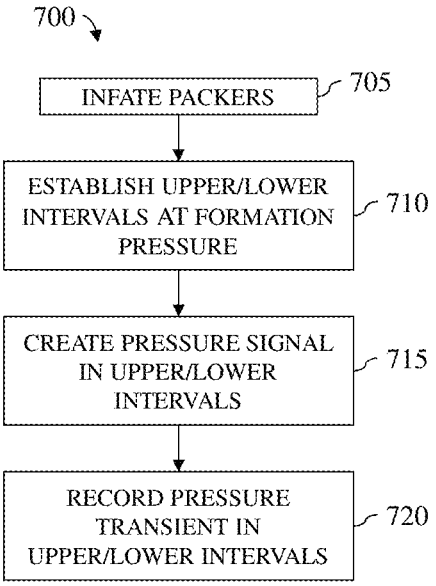
FIG. 10 is a flow-chart diagram of at least a portion of a method according to one or more aspects of the present disclosure.

Referring concurrently to FIG. 10, while lowering the dual combination packer system 670 into the well, the connection 620 to the wellbore may remain open, allowing fluid to enter above the piston 660, thus permitting a pressure-equalized chamber 655 and flowline 625. Thereafter, the packers 580 and 581 are inflated (705), such as by an amount sufficient to seal each of the packers 580 and 581 to the sidewall of the borehole.

One or more pumps 630 of the system 670 may then be operated to establish (710) the upper and lower intervals 206 and 207 at substantially formation pressure. During this time, the middle interval 205 may substantially remain at hydrostatic pressure.

The controller and/or other component of the system 670 may then be operated to create (715) a pressure pulse or other signal in either the upper or lower intervals 206 and/or 207. The resulting pressure pulse transmitted from one packer 580 (or 581) in the direction of the other packer 581 (or 580) may be substantially absorbed by the compressibility of the gas in the chamber 655. The controller and/or other component of the system 670 may then record (720) the pressure transient in both of the upper and lower intervals 206 and 207.

Figure 9:
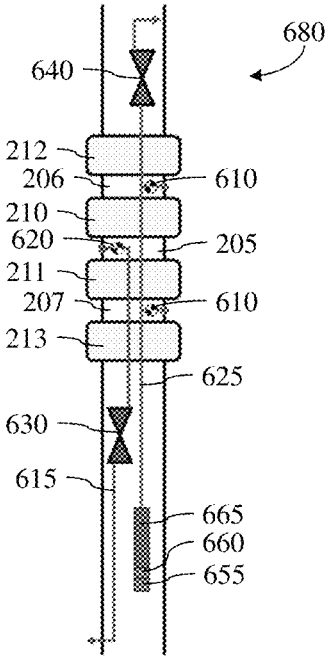
FIG. 9 is a schematic view of at least a portion of apparatus according to one or more aspects of the present disclosure.

FIG. 9 is a schematic view of another example implementation 680 of the quad-packer systems described above, in which the upper and lower intervals 206 and 207 are connected with the chamber 655 that contains gas below the piston 660 and wellbore fluid above the piston 660. As above, the gas in the chamber 655 may be pressurized before lowering the system 680 into the well.

Figure 12:
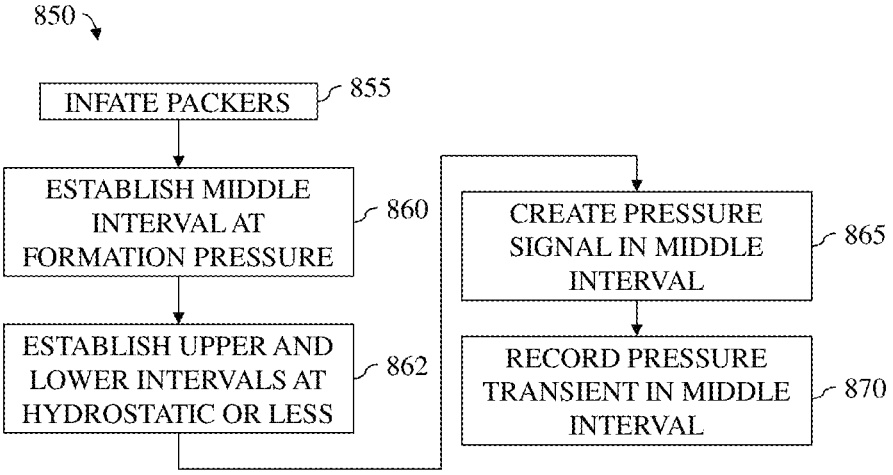
FIG. 12 is a flow-chart diagram of at least a portion of a method according to one or more aspects of the present disclosure.

Referring concurrently to FIG. 12, which is a flow-chart diagram of at least a portion of an example implementation of a method (850) for performing a VIT procedure, while lowering the tool into the well, the connections 610 to the wellbore may remain open, allowing wellbore fluid to enter above the piston 660, thus permitting a pressure-equalized chamber 655 and flowline 625. Thereafter, the packers 210-213 are inflated (855), such as by an amount sufficient to seal each of the packers 210-213 to the sidewall of the borehole.

One or more pumps 630 of the system 680 may then be operated to establish (860) the middle interval 205 at substantially formation pressure. The one or more pumps 630 may be transported downhole on drillstring, wireline, and/or other means, for example.

The upper and lower intervals 206 and 207 may be established (862) at substantially below hydrostatic pressure, but above formation pressure, perhaps via operation of one or more additional pumps 640 of the system 680. The controller and/or other component of the system 680 may then be operated to create (865) a pressure pulse and/or other signal in the middle interval 205, and then record (870) the pressure transient in the middle interval 205. The pressure pulse, signal, or related noise in the wellbore that is transmitted across one of the outer packers 212 and 213 may be absorbed by the compressibility of the gas in the chamber 655 that is connected to the upper and lower intervals 206 and 207.

Figure 13:
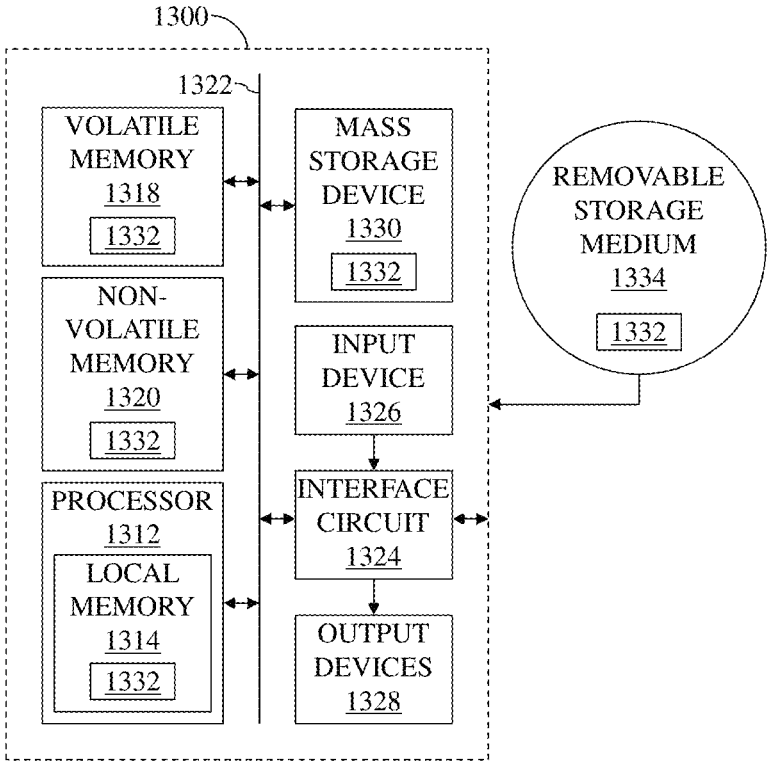
FIG. 13 is a schematic view of at least a portion of apparatus according to one or more aspects of the present disclosure.

FIG. 13 is a schematic view of at least a portion of apparatus according to one or more aspects of the present disclosure. The apparatus is or comprises a processing system 1300 that may execute example machine-readable instructions to implement at least a portion of one or more of the methods and/or processes described herein, and/or to implement a portion of one or more of the example downhole tools described herein. The processing system 1300 may be or comprise, for example, one or more processors, controllers, special-purpose computing devices, servers, personal computers, personal digital assistant ("PDA") devices, smartphones, internet appliances, and/or other types of computing devices. Moreover, while it is possible that the entirety of the processing system 1300 shown in FIG. 13 is implemented within downhole apparatus, it is also contemplated that one or more components or functions of the processing system 1300 may be implemented in wellsite surface equipment.

The processing system 1300 may comprise a processor 1312 such as, for example, a general-purpose programmable processor. The processor 1312 may comprise a local memory 1314, and may execute coded instructions 1332 present in the local memory 1314 and/or another memory device. The processor 1312 may execute, among other things, machine-readable instructions or programs to implement the methods and/or processes described herein. The programs stored in the local memory 1314 may include program instructions or computer program code that, when executed by an associated processor, enable surface equipment and/or downhole controller and/or control system to perform tasks as described herein. The processor 1312 may be, comprise, or be implemented by one or a plurality of processors of various types suitable to the local application environment, and may include one or more of general-purpose computers, special purpose computers, microprocessors, digital signal processors ("DSPs"), field-programmable gate arrays ("FPGAs"), application-specific integrated circuits ("ASICs"), and processors based on a multi-core processor architecture, as non-limiting examples. Of course, other processors from other families are also appropriate.

The processor 1312 may be in communication with a main memory, such as may include a volatile memory 1318 and a non-volatile memory 1320, perhaps via a bus 1322 and/or other communication means. The volatile memory 1318 may be, comprise, or be implemented by random access memory (RAM), static random access memory (SRAM), synchronous dynamic random access memory (SDRAM), dynamic random access memory (DRAM), RAMBUS dynamic random access memory (RDRAM) and/or other types of random access memory devices. The non-volatile memory 1320 may be, comprise, or be implemented by read only memory, flash memory and/or other types of memory devices. One or more memory controllers (not shown) may control access to the volatile memory 1318 and/or the non-volatile memory 1320.

The processing system 1300 may also comprise an interface circuit 1324. The interface circuit 1324 may be, comprise, or be implemented by various types of standard interfaces, such as an Ethernet interface, a universal serial bus (USB), a third generation input/output (3GIO) interface, a wireless interface, and/or a cellular interface, among others. The interface circuit 1324 may also comprise a graphics driver card. The interface circuit 1324 may also comprise a communication device such as a modem or network interface card to facilitate exchange of data with external computing devices via a network (e.g., Ethernet connection, digital subscriber line ("DSL"), telephone line, coaxial cable, cellular telephone system, satellite, etc.).

One or more input devices 1326 may be connected to the interface circuit 1324. The input device(s) 1326 may permit a user to enter data and commands into the processor 1312. The input device(s) 1326 may be, comprise, or be implemented by, for example, a keyboard, a mouse, a touchscreen, a track-pad, a trackball, an isopoint, and/or a voice recognition system, among others.

One or more output devices 1328 may also be connected to the interface circuit 1324. The output devices 1328 may be, comprise, or be implemented by, for example, display devices (e.g., a liquid crystal display or cathode ray tube display (CRT), among others), printers, and/or speakers, among others.

The processing system 1300 may also comprise one or more mass storage devices 1330 for storing machine-readable instructions and data. Examples of such mass storage devices 1330 include floppy disk drives, hard drive disks, compact disk (CD) drives, and digital versatile disk (DVD) drives, among others. The coded instructions 1332 may be stored in the mass storage device 1330, the volatile memory 1318, the non-volatile memory 1320, the local memory 1314, and/or on a removable storage medium 1334, such as a CD or DVD. Thus, the modules and/or other components of the processing system 1300 may be implemented in accordance with hardware (embodied in one or more chips including an integrated circuit such as an application specific integrated circuit), or may be implemented as software or firmware for execution by a processor. In particular, in the case of firmware or software, the embodiment can be provided as a computer program product including a computer readable medium or storage structure embodying computer program code (i.e., software or firmware) thereon for execution by the processor.

In view of the entirety of the present disclosure, including the figures, a person having ordinary skill in the art will recognize that the present disclosure introduces a method comprising: positioning a downhole tool within a wellbore that extends into a subterranean formation, wherein the downhole tool comprises a plurality of packers, the wellbore comprises wellbore fluid at hydrostatic pressure, and the subterranean formation comprises formation fluid at formation pressure; operating the plurality of packers to establish a plurality of annular intervals within the wellbore, wherein the plurality of annular intervals comprises an upper interval, a lower interval, and a middle interval interposing the upper and lower intervals; and operating the downhole tool to: establish the upper and lower intervals at formation pressure and establish the middle interval at hydrostatic pressure; and then create a pressure signal in one of the upper and lower intervals and then record a resulting pressure transient in both of the upper and lower intervals.

The method may further comprise, after operating the downhole tool to establish the middle interval at hydrostatic pressure, but before operating the downhole tool to create the pressure signal, operating the downhole tool to decrease the middle interval to substantially less than hydrostatic pressure.

Operating the downhole tool to establish the upper and lower intervals at formation pressure may comprise operating a first pump of the downhole tool that is in fluid communication with the upper and lower intervals via a first flowline extending within the downhole tool. Operating the downhole tool to create the pressure signal in one of the upper and lower intervals may comprise operating the first pump. Operating the downhole tool to establish the middle interval at hydrostatic pressure may comprise operating a second pump of the downhole tool that is in fluid communication with the middle interval via a second flowline extending within the downhole tool. The first and second flowlines may not be in fluid communication.

The method may further comprise pressurizing a chamber of the downhole tool to a predetermined pressure before positioning the downhole tool within the wellbore, wherein: the downhole tool may further comprise a piston; a first side of the piston may define a moveable boundary of the chamber; and a second side of the piston may be in fluid communication with the hydrostatic pressure of the wellbore.

Operating the downhole tool to establish the middle interval at hydrostatic pressure may comprise fluidly connecting the middle interval to an additional wellbore interval at hydrostatic pressure via a first flowline extending within the downhole tool. Operating the downhole tool to establish the upper and lower intervals at formation pressure may comprise operating a pump of the downhole tool that is in fluid communication with the upper and lower intervals via a second flowline extending within the downhole tool. The first and second flowlines may not be in fluid communication. Operating the downhole tool to create the pressure signal in one of the upper and lower intervals may comprise operating the pump.

The plurality of packers may comprise a first packer, a second packer, a third packer, and a fourth packer, wherein: the upper interval interposes the first and second packers; the middle interval interposes the second and third packers; and the lower interval interposes the third and fourth packers. Operating the downhole tool to establish the middle interval at hydrostatic pressure may comprise fluidly connecting the middle interval to an additional wellbore interval at hydrostatic pressure via a first flowline extending within the downhole tool. Operating the downhole tool to establish the upper and lower intervals at formation pressure may comprise operating a pump of the downhole tool that is in fluid communication with the upper and lower intervals via a second flowline extending within the downhole tool. The first and second flowlines may not be in fluid communication. Operating the downhole tool to create the pressure signal in one of the upper and lower intervals may comprise operating the pump.

The plurality of packers may comprise an upper packer and a lower packer, wherein: the upper interval interposes upper and lower portions of the upper packer; the lower interval interposes upper and lower portions of the lower packer; and the middle interval interposes the lower portion of the upper packer and the upper portion of the lower packer. Operating the downhole tool to establish the middle interval at hydrostatic pressure may comprise fluidly connecting the middle interval to an additional wellbore interval at hydrostatic pressure via a first flowline extending within the downhole tool. Operating the downhole tool to establish the upper and lower intervals at formation pressure may comprise operating a pump of the downhole tool that is in fluid communication with the upper and lower intervals via a second flowline extending within the downhole tool. The first and second flowlines may not be in fluid communication. Operating the downhole tool to create the pressure signal in one of the upper and lower intervals may comprise operating the pump. The pump may be a first pump, the downhole tool may further comprise a second pump that is in fluid communication with the middle interval via the first flowline, and operating the downhole tool to establish the middle interval at hydrostatic pressure may comprise operating the second pump. The method may further comprise pressurizing a chamber of the downhole tool to a predetermined pressure before positioning the downhole tool within the wellbore, wherein: the downhole tool may further comprise a piston; a first side of the piston may define a moveable boundary of the chamber; and a second side of the piston may be in fluid communication with the hydrostatic pressure of the wellbore via the first flowline.

The present disclosure also introduces a method comprising: positioning a downhole tool within a wellbore that extends into a subterranean formation, wherein the downhole tool comprises a plurality of packers, the wellbore comprises wellbore fluid at hydrostatic pressure, and the subterranean formation comprises formation fluid at formation pressure; operating the plurality of packers to establish a plurality of annular intervals within the wellbore, wherein the plurality of annular intervals comprises an upper interval, a lower interval, and a middle interval interposing the upper and lower intervals; and operating the downhole tool to: establish the middle interval at formation pressure and establish the upper and lower intervals at below hydrostatic pressure but above formation pressure; and then create a pressure signal in the middle interval and then record a resulting pressure transient in the middle interval. Operating the downhole tool to establish the middle interval at formation pressure may comprise operating a first pump of the downhole tool that is in fluid communication with the middle interval via a first flowline extending within the downhole tool. Operating the downhole tool to create the pressure signal in the middle interval may comprise operating the first pump. Operating the downhole tool to establish the upper and lower intervals at below hydrostatic pressure but above formation pressure may comprise operating a second pump of the downhole tool that is in fluid communication with the upper and lower intervals via a second flowline extending within the downhole tool. The first and second flowlines may not be in fluid communication. The method may further comprise pressurizing a chamber of the downhole tool to a predetermined pressure before positioning the downhole tool within the wellbore, wherein: the downhole tool may further comprise a piston; a first side of the piston may define a moveable boundary of the chamber; and a second side of the piston may be in fluid communication with the hydrostatic pressure of the wellbore.

The plurality of packers may comprise a first packer, a second packer, a third packer, and a fourth packer, wherein the upper interval interposes the first and second packers, the middle interval interposes the second and third packers, and the lower interval interposes the third and fourth packers.

The plurality of packers may comprise an upper packer and a lower packer, wherein the upper interval interposes upper and lower portions of the upper packer, the lower interval interposes upper and lower portions of the lower packer, and the middle interval interposes the lower portion of the upper packer and the upper portion of the lower packer.

The present disclosure also introduces an apparatus comprising: a downhole tool conveyable within a wellbore that extends into a subterranean formation, wherein the wellbore comprises wellbore fluid at hydrostatic pressure, the subterranean formation comprises formation fluid at formation pressure, and the downhole tool comprises a plurality of packers and a controller operable to: operate the plurality of packers to establish a plurality of annular intervals within the wellbore, wherein the plurality of annular intervals comprises an upper interval, a lower interval, and a middle interval interposing the upper and lower intervals; establish the upper and lower intervals at formation pressure and establish the middle interval at hydrostatic pressure; and then create a pressure signal in one of the upper and lower intervals and then record a resulting pressure transient in both of the upper and lower intervals.

The plurality of packers may comprise a first packer, a second packer, a third packer, and a fourth packer, wherein the upper interval interposes the first and second packers, the middle interval interposes the second and third packers, and the lower interval interposes the third and fourth packers.

The plurality of packers may comprise an upper packer and a lower packer, wherein the upper interval interposes upper and lower portions of the upper packer, the lower interval interposes upper and lower portions of the lower packer, and the middle interval interposes the lower portion of the upper packer and the upper portion of the lower packer.

The controller may be further operable to: establish the middle interval at formation pressure and establish the upper and lower intervals at below hydrostatic pressure but above formation pressure; and then create a pressure signal in the middle interval and then record a resulting pressure transient in the middle interval.

The foregoing outlines features of several embodiments so that a person having ordinary skill in the art may better understand the aspects of the present disclosure. A person having ordinary skill in the art should appreciate that they may readily use the present disclosure as a basis for designing or modifying other processes and structures for carrying out the same purposes and/or achieving the same advantages of the embodiments introduced herein. A person having ordinary skill in the art should also realize that such equivalent constructions do not depart from the scope of the present disclosure, and that they may make various changes, substitutions and alterations herein without departing from the spirit and scope of the present disclosure.

The Abstract at the end of this disclosure is provided to comply with 37 C.F.R. §1.72(b) to allow the reader to quickly ascertain the nature of the technical disclosure. It is submitted with the understanding that it will not be used to interpret or limit the scope or meaning of the claims.

What is claimed is:

1. A method, comprising:

positioning a downhole tool within a wellbore that extends into a subterranean formation, wherein the downhole tool comprises a plurality of packers, the wellbore comprises wellbore fluid at hydrostatic pressure, and the subterranean formation comprises formation fluid at formation pressure;

operating the plurality of packers to establish a plurality of annular intervals within the wellbore, wherein the plurality of annular intervals comprises an upper interval, a lower interval, and a middle interval interposing the upper and lower intervals; and operating the downhole tool to:

establish the upper and lower intervals at formation pressure and establish the middle interval at hydrostatic pressure; and then create a pressure signal in one of the upper and lower intervals and then record a resulting pressure transient in both of the upper and lower intervals.

2. The method of claim 1 further comprising, after operating the downhole tool to establish the middle interval at hydrostatic pressure, but before operating the downhole tool to create the pressure signal, operating the downhole tool to decrease the middle interval to substantially less than hydrostatic pressure.

3. The method of claim 1 wherein:

operating the downhole tool to establish the upper and lower intervals at formation pressure comprises operating a first pump of the downhole tool that is in fluid communication with the upper and lower intervals via a first flowline extending within the downhole tool;

operating the downhole tool to create the pressure signal in one of the upper and lower intervals comprises operating the first pump;

operating the downhole tool to establish the middle interval at hydrostatic pressure comprises operating a second pump of the downhole tool that is in fluid communication with the middle interval via a second flowline extending within the downhole tool; and the first and second flowlines are not in fluid communication.

4. The method of claim 1 further comprising pressurizing a chamber of the downhole tool to a predetermined pressure before positioning the downhole tool within the wellbore, wherein:

the downhole tool further comprises a piston;

a first side of the piston defines a moveable boundary of the chamber; and a second side of the piston is in fluid communication with the hydrostatic pressure of the wellbore.

5. The method of claim 1 wherein:

operating the downhole tool to establish the middle interval at hydrostatic pressure comprises fluidly connecting the middle interval to an additional wellbore interval at hydrostatic pressure via a first flowline extending within the downhole tool;

operating the downhole tool to establish the upper and lower intervals at formation pressure comprises operating a pump of the downhole tool that is in fluid communication with the upper and lower intervals via a second flowline extending within the downhole tool;

the first and second flowlines are not in fluid communication; and operating the downhole tool to create the pressure signal in one of the upper and lower intervals comprises operating the pump.

6. The method of claim 1 wherein:

the plurality of packers comprises a first packer, a second packer, a third packer, and a fourth packer;

the upper interval interposes the first and second packers;

the middle interval interposes the second and third packers; and the lower interval interposes the third and fourth packers.

7. The method of claim 6 wherein:

operating the downhole tool to establish the middle interval at hydrostatic pressure comprises fluidly connecting the middle interval to an additional wellbore interval at hydrostatic pressure via a first flowline extending within the downhole tool;

operating the downhole tool to establish the upper and lower intervals at formation pressure comprises operating a pump of the downhole tool that is in fluid communication with the upper and lower intervals via a second flowline extending within the downhole tool;

the first and second flowlines are not in fluid communication; and operating the downhole tool to create the pressure signal in one of the upper and lower intervals comprises operating the pump.

8. The method of claim 1 wherein:

the plurality of packers comprises an upper packer and a lower packer;

the upper interval interposes upper and lower portions of the upper packer;

the lower interval interposes upper and lower portions of the lower packer; and the middle interval interposes the lower portion of the upper packer and the upper portion of the lower packer.

9. The method of claim 8 wherein:

operating the downhole tool to establish the middle interval at hydrostatic pressure comprises fluidly connecting the middle interval to an additional wellbore interval at hydrostatic pressure via a first flowline extending within the downhole tool;

operating the downhole tool to establish the upper and lower intervals at formation pressure comprises operating a pump of the downhole tool that is in fluid communication with the upper and lower intervals via a second flowline extending within the downhole tool;

the first and second flowlines are not in fluid communication; and operating the downhole tool to create the pressure signal in one of the upper and lower intervals comprises operating the pump.

10. The method of claim 9 wherein:

the pump is a first pump;

the downhole tool further comprises a second pump that is in fluid communication with the middle interval via the first flowline; and operating the downhole tool to establish the middle interval at hydrostatic pressure comprises operating the second pump.

11. The method of claim 10 further comprising pressurizing a chamber of the downhole tool to a predetermined pressure before positioning the downhole tool within the wellbore, wherein:

the downhole tool further comprises a piston;

a first side of the piston defines a moveable boundary of the chamber; and a second side of the piston is in fluid communication with the hydrostatic pressure of the wellbore via the first flowline.

12. A method, comprising:

positioning a downhole tool within a wellbore that extends into a subterranean formation, wherein the downhole tool comprises a plurality of packers, the wellbore comprises wellbore fluid at hydrostatic pressure, and the subterranean formation comprises formation fluid at formation pressure;

operating the plurality of packers to establish a plurality of annular intervals within the wellbore, wherein the plurality of annular intervals comprises an upper interval, a lower interval, and a middle interval interposing the upper and lower intervals; and operating the downhole tool to:

establish the middle interval at formation pressure and establish the upper and lower intervals at below hydrostatic pressure but above formation pressure; and then create a pressure signal in the middle interval and then record a resulting pressure transient in the middle interval.

13. The method of claim 12 wherein:

operating the downhole tool to establish the middle interval at formation pressure comprises operating a first pump of the downhole tool that is in fluid communication with the middle interval via a first flowline extending within the downhole tool;

operating the downhole tool to create the pressure signal in the middle interval comprises operating the first pump;

operating the downhole tool to establish the upper and lower intervals at below hydrostatic pressure but above formation pressure comprises operating a second pump of the downhole tool that is in fluid communication with the upper and lower intervals via a second flowline extending within the downhole tool; and the first and second flowlines are not in fluid communication.

14. The method of claim 12 further comprising pressurizing a chamber of the downhole tool to a predetermined pressure before positioning the downhole tool within the wellbore, wherein:

the downhole tool further comprises a piston;

a first side of the piston defines a moveable boundary of the chamber; and a second side of the piston is in fluid communication with the hydrostatic pressure of the wellbore.

15. The method of claim 12 wherein:

the plurality of packers comprises a first packer, a second packer, a third packer, and a fourth packer;

the upper interval interposes the first and second packers;

the middle interval interposes the second and third packers; and the lower interval interposes the third and fourth packers.

16. The method of claim 12 wherein:

the plurality of packers comprises an upper packer and a lower packer;

the upper interval interposes upper and lower portions of the upper packer;

the lower interval interposes upper and lower portions of the lower packer; and the middle interval interposes the lower portion of the upper packer and the upper portion of the lower packer.

17. The method of claim 16 wherein:

operating the downhole tool to establish the middle interval at hydrostatic pressure comprises fluidly connecting the middle interval to an additional wellbore interval at hydrostatic pressure via a first flowline extending within the downhole tool;

operating the downhole tool to establish the upper and lower intervals at formation pressure comprises operating a pump of the downhole tool that is in fluid communication with the upper and lower intervals via a second flowline extending within the downhole tool;

the first and second flowlines are not in fluid communication; and operating the downhole tool to create the pressure signal in one of the upper and lower intervals comprises operating the pump.

18. The method of claim 17 wherein:

the pump is a first pump;

the downhole tool further comprises a second pump that is in fluid communication with the middle interval via the first flowline; and operating the downhole tool to establish the middle interval at hydrostatic pressure comprises operating the second pump.

19. The method of claim 18 further comprising pressurizing a chamber of the downhole tool to a predetermined pressure before positioning the downhole tool within the wellbore, wherein:

the downhole tool further comprises a piston;

a first side of the piston defines a moveable boundary of the chamber; and a second side of the piston is in fluid communication with the hydrostatic pressure of the wellbore via the first flowline.

* * * * *